US007717767B2

(12) United States Patent
Amadio et al.

(10) Patent No.: US 7,717,767 B2
(45) Date of Patent: May 18, 2010

(54) MODULAR TOY VEHICLE ACCESSORY MOUNTS

(75) Inventors: Donald W. Amadio, Oaklyn, NJ (US); James V. Mendillo, Medford, NJ (US); Yuk Kei Chan, New Territories (HK)

(73) Assignee: Ridemakerz, LLC, Rancho Santa Margarita, CA (US)

( * ) Notice: Subject to any disclaimer, the term of this patent is extended or adjusted under 35 U.S.C. 154(b) by 52 days.

(21) Appl. No.: 11/735,995

(22) Filed: Apr. 16, 2007

(65) Prior Publication Data

US 2008/0254708 A1 Oct. 16, 2008

(51) Int. Cl.
*A63H 17/26* (2006.01)

(52) U.S. Cl. ..... 446/95; 446/94; 446/427

(58) Field of Classification Search ..... None
See application file for complete search history.

(56) References Cited

U.S. PATENT DOCUMENTS

| | | | | |
|---|---|---|---|---|
| 2,587,142 | A | 2/1952 | Gray et al. | |
| 2,791,867 | A | 5/1957 | Dasher | |
| 2,803,920 | A | 8/1957 | Salosky | |
| 3,962,820 | A | 6/1976 | Good et al. | |
| 4,183,173 | A | 1/1980 | Ogawa | |
| 4,214,402 | A | 7/1980 | Ogawa | |
| 4,248,006 | A | 2/1981 | Jones et al. | |
| 4,307,533 | A | 12/1981 | Sims et al. | |
| 4,723,931 | A | 2/1988 | Allen et al. | |
| 4,895,542 | A * | 1/1990 | de Blanitza | 446/94 |
| 4,993,983 | A | 2/1991 | Kurita et al. | |
| 5,167,563 | A | 12/1992 | Saffer | |
| 5,277,643 | A | 1/1994 | Ejima | |
| 5,295,889 | A * | 3/1994 | Ejima | 446/91 |
| 5,389,031 | A | 2/1995 | Sharpe, III et al. | |
| 5,512,001 | A | 4/1996 | Kent et al. | |
| 6,659,837 | B1 * | 12/2003 | Lieberman | 446/220 |
| 6,773,321 | B1 * | 8/2004 | Urquiaga | 446/454 |
| 6,830,469 | B1 | 12/2004 | Doyle et al. | |

(Continued)

FOREIGN PATENT DOCUMENTS

DE 2254070 A * 5/1974

(Continued)

*Primary Examiner*—Ronald Laneau
*Assistant Examiner*—Tramar Harper
(74) *Attorney, Agent, or Firm*—Mark E. Stallion, Esq.; Husch Blackwell Sanders LLP

(57) ABSTRACT

A toy vehicle design having two distinctly different methods to attach accessories. Accessories that attach to the front, sides, rear and bottom of the vehicle can connect to the chassis via a tab and slot system. Strategically positioned slots on the chassis undercarriage can accept tabs that extend from those accessories. The various accessories can be interchangeable and can be easily attached and removed without the need for tools. For front, side, rear and bottom fitting accessories, slots can be located along the outer perimeter of the vehicle chassis' undercarriage. The accept tabs can extend from the various accessories. Accessories that attach to the hood, roof and truck beds, magnets are built into the underside of the vehicle body with magnets of the opposite polarity attached to the inside of the accessories. For electronic accessories, the present invention can utilize female electrical connectors that can be located along the sides of the chassis undercarriage to accept male electrical connectors attached to accessories.

15 Claims, 4 Drawing Sheets

U.S. PATENT DOCUMENTS

| | | | |
|---|---|---|---|
| 6,887,120 | B2 | 5/2005 | Shamitoff |
| 6,910,939 | B2 | 6/2005 | Hui |
| 6,918,627 | B2 | 7/2005 | Mataja et al. |
| 6,945,840 | B2 | 9/2005 | Hui |
| 6,957,996 | B2 | 10/2005 | Hui |
| 7,055,889 | B2 | 6/2006 | Mataja et al. |
| 7,059,661 | B2 | 6/2006 | Mataja et al. |
| 2002/0177384 | A1 | 11/2002 | Mankowski |
| 2004/0198143 | A1* | 10/2004 | Grzesek et al. ..... 446/129 |
| 2004/0248450 | A1 | 12/2004 | Masaki et al. |
| 2006/0178081 | A1 | 8/2006 | Daftari et al. |

FOREIGN PATENT DOCUMENTS

| | | | |
|---|---|---|---|
| WO | 8603895 | A1 | 7/1986 |

* cited by examiner

MODULAR TOY VEHICLE ACCESSORY MOUNTS

BACKGROUND OF INVENTION

1. Field of Invention

This invention relates generally to toy vehicles and, more particularly, to modularity of toy vehicles.

2. Background Art

Radio-controlled (RC) cars as well as other toy cars, have been very popular with children of various ages over the years. However, a disadvantage of many toy cars is that generally speaking they are fixed in design and cannot be changed. This means that a child can often become bored with them after a period of time. Furthermore, many children express satisfaction with being able to build or work on a toy themselves. Yet, many radio-controlled cars and other toy cars have a complex construction and have components which are complicated and not easily adapted to be built or switched out by children. What is needed is a toy vehicle having universally and easily interchangeable components such that a child may be able to build or customize their own toys.

Attempts have been made to design toy vehicles with interchangeable components, however, the interchangeable modules for a given vehicle design can each have a distinctly different attachment mechanisms. For example, for a given vehicle, there can be multiple types of attachment mechanisms for the front bumper area of the vehicle and a totally different set of attachment mechanisms for the sides and rear of the vehicle. A more simple design is needed for attachments and accessories where the attachment mechanisms are more universal and easy for children of all ages to install.

Attempts have been made to develop less complex designs and with more universal attachment mechanisms, however, the designs are quite convoluted in that a child can place any accessory at any location on the toy vehicle, even at locations where the accessory is not intended to be installed. A design is needed where the attachment mechanisms are universal, but the design is such that accessories can only be installed at their intended locations. Further, many attempts to develop a design that addresses this need has resulted in a design with a less than appealing appearance having unsightly holes or contact points at locations that take away from the appearance of the vehicle, particularly when an accessory is not installed. This is particularly important when the owner of the toy vehicle is concerned about whether the appearance of the vehicle closely mimics the appearance of a full size vehicle. Unsightly holes or contact points all over the vehicle negates the attempt to mimic the appearance of a full size vehicle.

Further, the attempts to develop a design having interchangeable accessories and attachments have not provided mechanisms for supplying power to accessories, such as for example, providing power to accessories having LED lights and/or sound emitting devices. There are various toy vehicle designs that exist that include light emitting and/or sound emitting devices, however, these devices are not interchangeable accessories.

BRIEF SUMMARY OF INVENTION

The invention is a modular toy vehicle system having a plurality of accessory attach mechanisms whereby any number of toy vehicle accessories can be attached on, removed from and replaced on various areas of the vehicle with no visible means of attachment to detract from the appearance of the vehicle once the accessories is installed. The toy retail business model typically does not require that a large number of after-market customizing accessories be sold for the variety of vehicles—vehicles of different sizes and genres. One challenge is that accessories have not been developed that can attach to the front, top, side, bottom and rear of toy vehicles and a more standardized universal method (or methods) of attachment has not been developed that would allow for the attachment of all these various accessories to all these vehicles without compromising the aesthetic integrity of the vehicle's design and form. Toy vehicles, such as for example radio controlled (RC) vehicles, have not been designed with the proper universal docking mechanisms or receptacles that would allow various different accessories having the mating universal mechanism to attach to the vehicle.

A typical toy vehicle design includes a body and a chassis. Though not necessary, the body can substantially lower the rear, top, left and right portions of the chassis. Depending on the type of accessory desired, it may be more desirable to attach the accessory to the chassis or it may be more desirable to attach it to the body. Therefore, there can be multiple types of universal docking mechanisms integrated into the toy vehicle where each of the universal docking types are designed based on the general category or type of docking location (for example under chassis docking) and to accommodate an anticipated accessory type for a given docking location (for example front, side, or rear).

The present invention is a toy vehicle design having two distinctly different universal methods to attach accessories. Accessories that attach to the front, sides, or rear and near the bottom of the vehicle can connect to the chassis via a tab and slot system. Strategically positioned slots on the chassis undercarriage extending or protruding from an underside surface of the chassis can accept tabs that extend from those accessories. The tabs of the accessories can simply laterally "plug in" to the slots on the chassis. The slots can be positioned adjacent the rear end, front end, left side and/or right side. The various accessories can be interchangeable and can be easily attached and removed without the need for tools. For front, side, rear and bottom fitting accessories, slots can be located along the outer perimeter of the vehicle chassis' undercarriage. The tabs can extend from the various accessories. The slots shown in the drawing are stirrup-like slots with an open ended through-hole or eyelet. However the slots can take on other embodiments without departing from the scope of the invention, such as for example, elongated slots open on both ends or close on one end.

The slots can be made of a durable resilient plastic. The slot can essentially be plastic loops with a center eyelet through which the tab of the accessory can be inserted. The loop can be pliable enough allowing a tab of an accessory to pass there through, but resilient enough to maintain its form for securely holding the accessory in place. The tabs can be made of a similar plastic and can have two parallel prongs with a lengthwise uniform gap there between for inserting into the slot. When the prongs of the tabs can be laterally inserted or press fitted through the slots, the prongs will be urged to bend inwardly, one toward the other, due to the dimension of the opening of the slot. The resiliency of the prongs will cause the prongs to apply an outward force against the inside of the slot thereby holding the accessory securely in place. The tabs could include detents or cut outs for receiving the slots and locking the accessory in place.

For accessories that attach to the hood, roof and truck beds, magnets can be built into the underside of the vehicle body or embedded in the body beneath the surface of the body with magnets of the opposite polarity attached to the inside of the accessories. The result is an invisible connection. The accessory and body can be formed of plastic. The magnets can be formed inside the plastic just beneath the outer surface. The magnets can have sufficient strength to attract each other through the thin layers of plastic.

For electronic accessories, the present invention can utilize female electrical chassis connectors that can be located along the sides of the chassis undercarriage to accept male electrical accessory connectors attached to accessories. This allows the accessory to be powered by the vehicle's internal power source. The female connectors can be electrically connected to the battery power source of the toy vehicle.

The drawing shows an example of a powered accessory, which in this case is an under carriage light. The accessory is shown having a tab which has two prongs. The prongs of the tab can be laterally inserted into the slots. This accessory can have a male electrical contact for inserting into the female receptacle to establish a power connection for the accessory.

The type of magnetic accessories that could be attached include magnetized hood scoops, magnetized emergency lights, side pipes, under carriage lighting and various other accessory items. Please refer to the drawing and detailed description for further details relating to this invention.

These and other advantageous features of the present invention will be in part apparent and in part pointed out herein below.

BRIEF DESCRIPTION OF THE DRAWINGS

For a better understanding of the present invention, reference may be made to the accompanying drawings in which.

Figure 1:
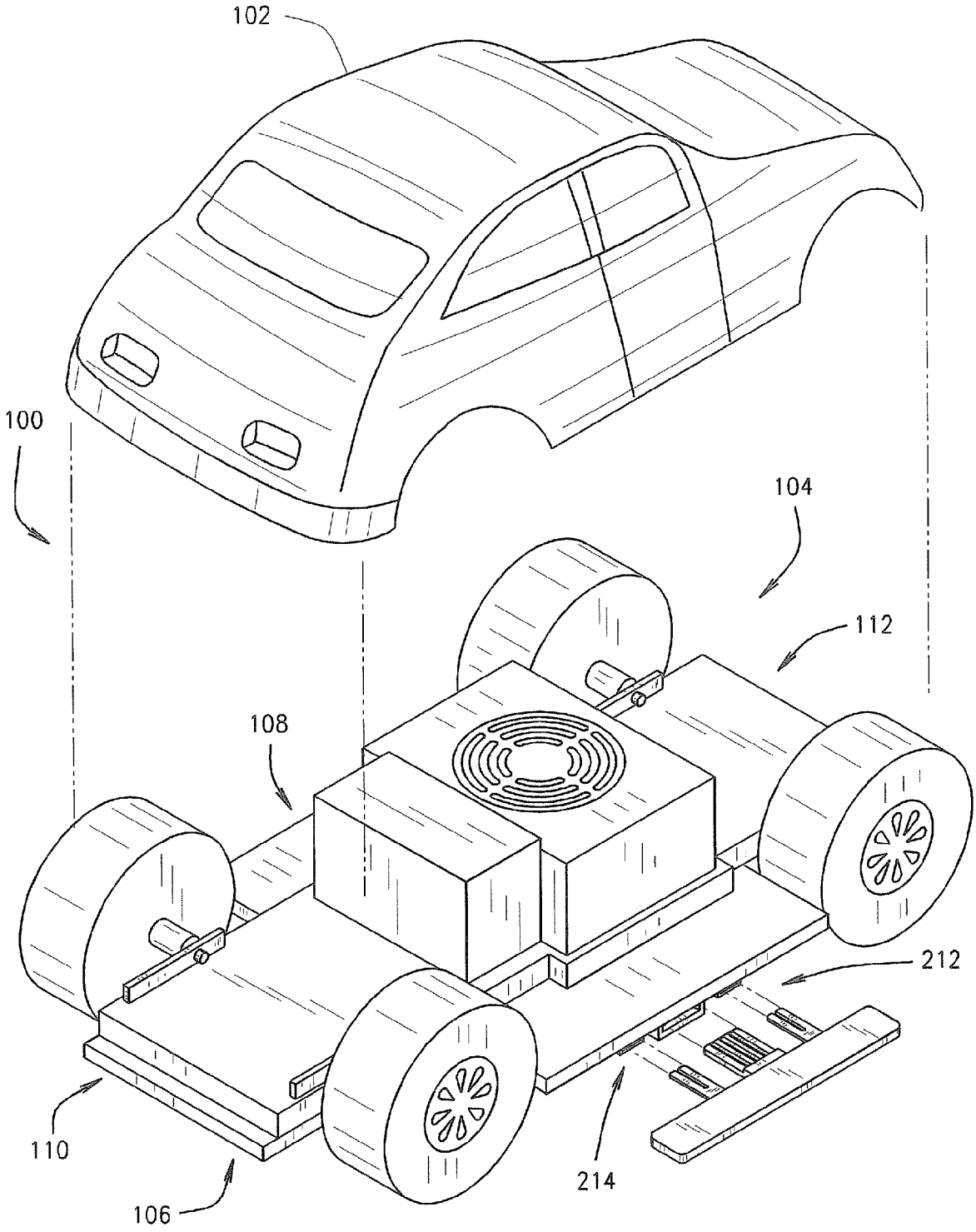
FIG. 1 is an exploded perspective view of a body and chassis.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF INVENTION

According to the embodiment(s) of the present invention, various views are illustrated in FIG. 1-6 and like reference numerals are being used consistently throughout to refer to like and corresponding parts of the invention for all of the various views and figures of the drawing. Also, please note that the first digit(s) of the reference number for a given item or part of the invention should correspond to the Fig. number in which the item or part is first identified.

One embodiment of the present invention is a customizable toy comprising a toy vehicle having magnetic body mounts and bottom chassis mounts with an electrical connection, which teaches a novel apparatus and method for a toy vehicle having interchangeable universally mountable accessories.

The details of the invention and various embodiments can be better understood by referring to the figures of the drawing. Referring to FIG. 1, and the exploded perspective view of a toy vehicle 100 including a body 102 and chassis 104. The body 102 mounts on top of a chassis 104 thereby providing the exterior appearance of the vehicle. The body can typically substantially cover the chassis 104 such that minimal portions of the chassis are in view. The chassis underside 106 can be fully exposed. The chassis can have two sides 108, a chassis rear end 110 and a chassis front end 112. The toy vehicle is designed such that various accessories can be attached with no degradation to the appearance of the vehicle particularly when the body is mounted on the chassis.

Figure 2:
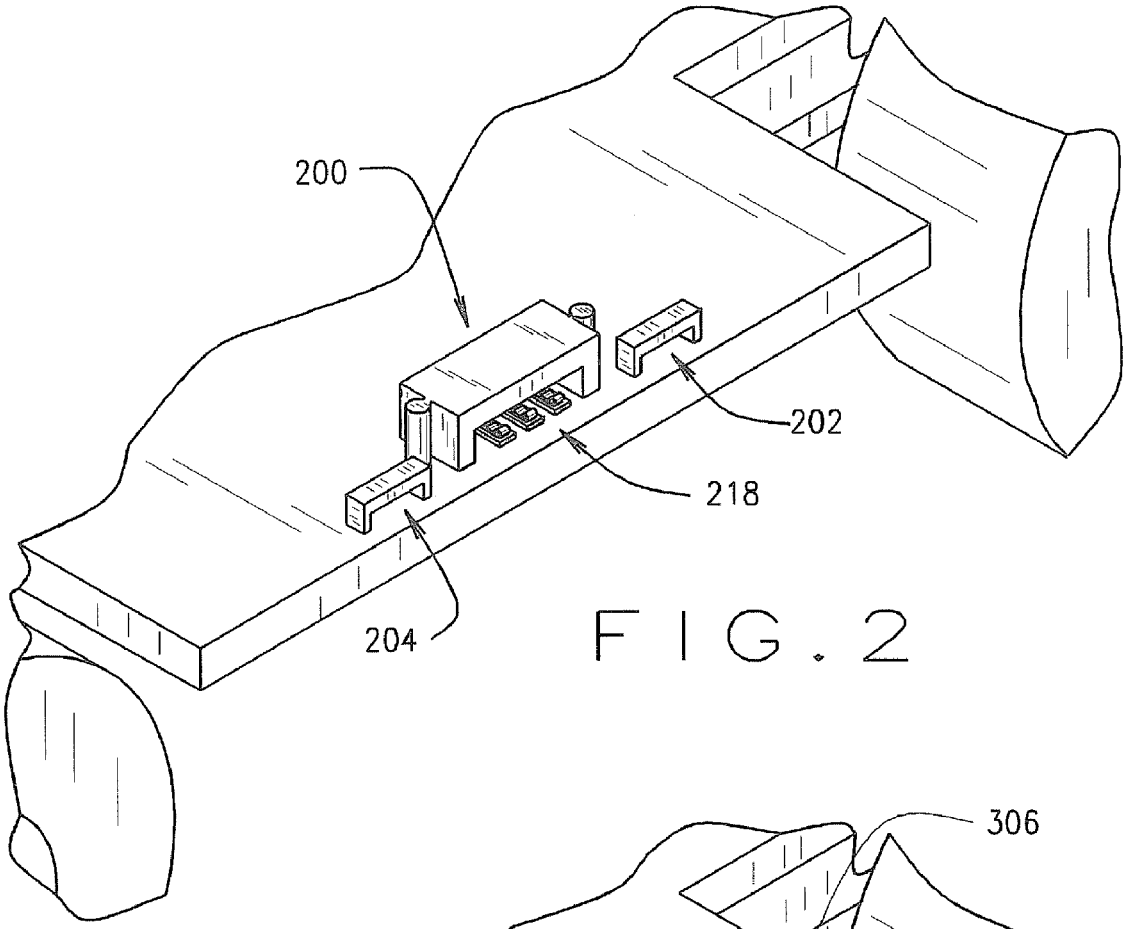
FIG. 2 is a perspective view of a chassis side mount with integral electrical connector.

Referring to FIG. 2, a chassis side mount 200 is shown. The mounts are shown located on the underside of the chassis proximate the side edge. The left side front mount 202 is a stirrup-like slot or loop such that a mounting tab can be installed there through. The left side chassis mount is shown comprising a left side front mount 202 and a left side rear mount 204. Also, right side front and rear mounts are illustrated as 206. The front left and right mounts are shown 202 and 212. The rear left side and right side mounts 204 and 214 are also shown. The stirrup-like slots or loops can be combined with an electrical connector 218 for providing power to an accessory. The stirrup-like slot or loop provides for a universal docking mount that can be utilized for the sides, the front and the rear. The location of the stirrup-like slot or loop can be on the underside proximate an edge of the chassis, which provides a discreet location that does not take away from the appearance of the vehicle. The stirrup-like slots or loops can be provided in pairs for increased stability, however, a single stirrup can also be provided. The spacing between a pair of stirrup-like slots or loops can be different for the front, rear and sides to assure that an accessory is not installed at the improper location.

Figure 3:
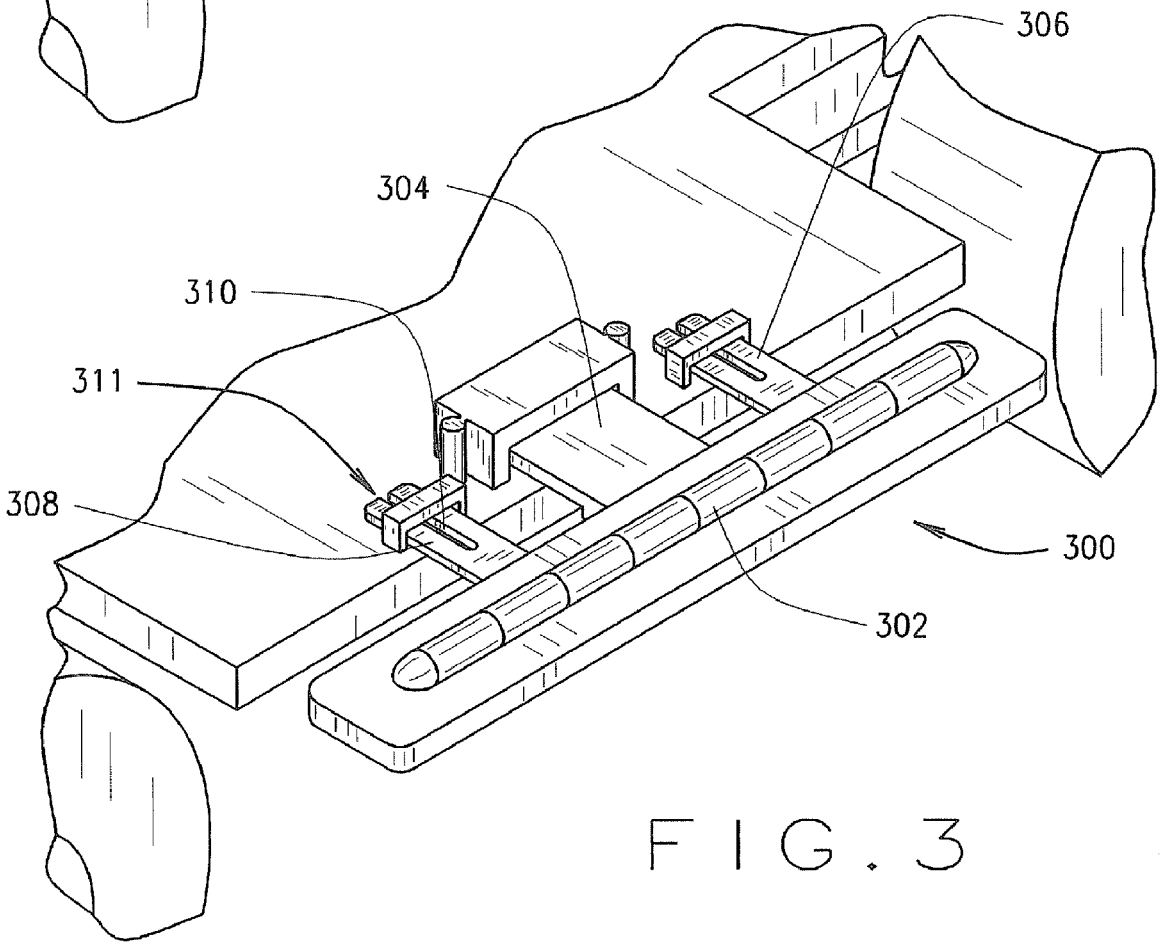
FIG. 3 is a perspective view of a chassis side mount with a light equipped accessory partially inserted.
Figure 4:
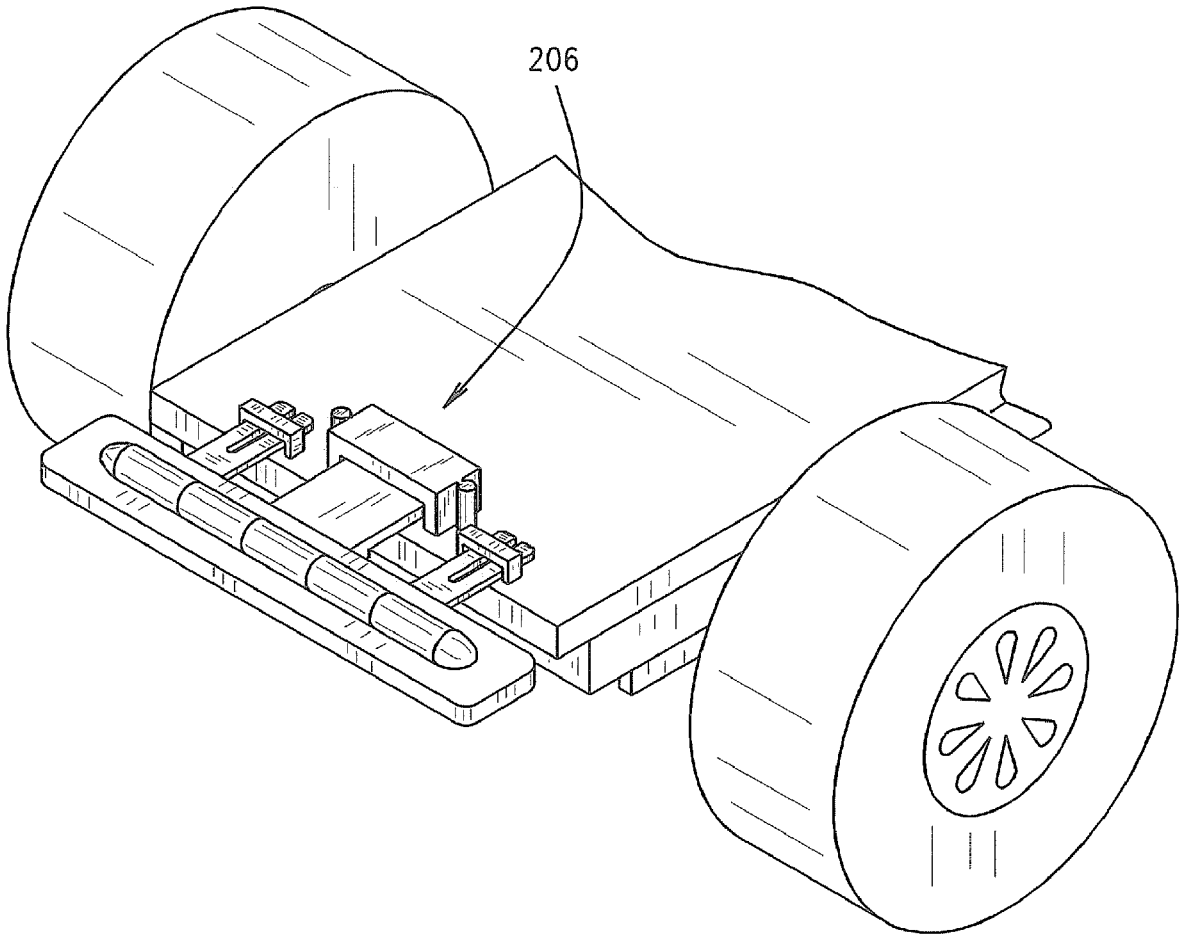
FIG. 4 is a perspective view of a chassis front mount.

Referring to FIG. 3, a light equipped accessory 300 is shown partially installed on a side mount. The accessory is shown having a light 302 and an accessory male connector 304 for mating with electrical chassis connector 218. The accessory is shown having a front mounting tab 306 and a rear mounting tab 308. Each tab can be constricted having two prongs 310 that are parallel having a uniform gap 311 there between. The prongs can be constructed of a resilient flexible material that allows the prongs to press inward, one towards the other, when being inserted into the slot of the mount. The resiliency of the prongs will tend to urge outward one with respect to the other thereby pressing on the inside of the slot and securely fixing the accessory to the mount. The spacing between the tabs can be designed to correspond with the spacing between the slots. For accessories designed to be side mounted, the spacing between the tabs will correspond to the spacing between the slots for the side mount. Similarly, for accessories designed to be front or rear mounted will have spacing between the tabs to correspond with the spacing between the slots for the rear or forward mount. Please note that accessories not requiring power for lightning, sound or otherwise, do not require the electrical connector 304 as shown. An example of an accessory not having connector 304 is now shown in the drawing, however one skilled in the art would understand this description. FIG. 4 provides a perspective view of a front mount 206. The front mounts and rear mounts can be similarly designed and can also have a connector for electrical power to the accessory. The universal design of the stirrup-like slots can allow for various types of accessories to be attached to the toy vehicle without taking away from the aesthetic appearance of the vehicle. The mounting slot location on the underside of the vehicle chassis provides a discreet location that cannot be readily seen by an observer. Accessories that don't need power can eliminate the center male connector 304.

Figure 5:
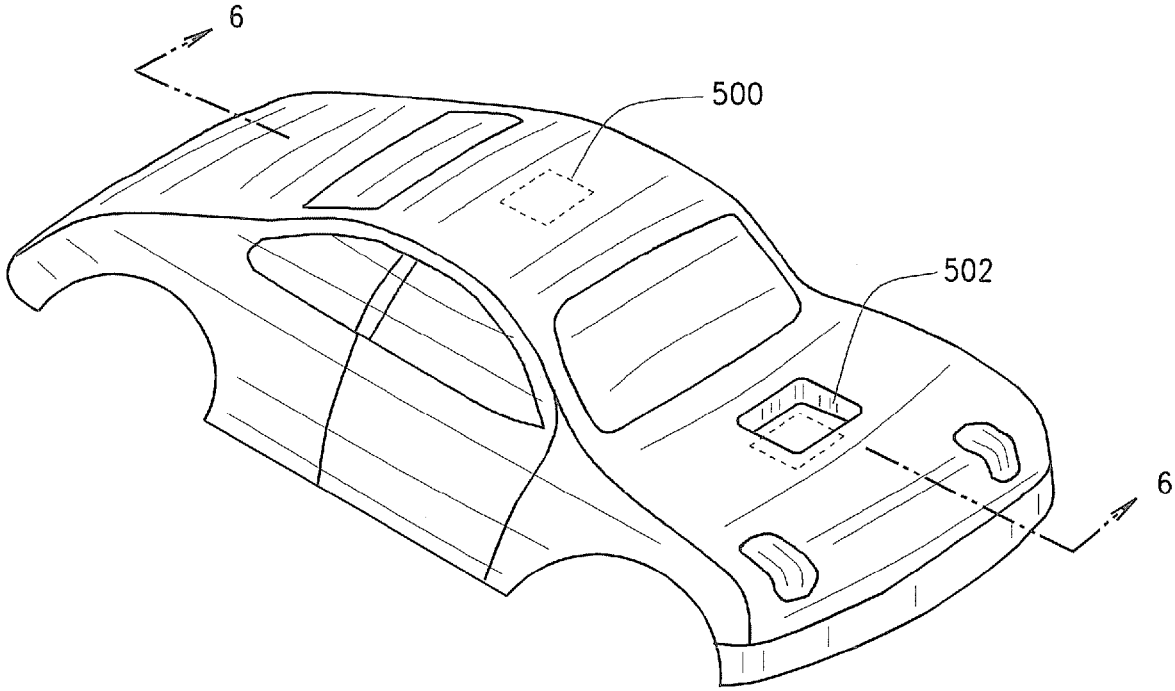
FIG. 5 is a perspective view of the magnetic body mounts.
Figure 6:
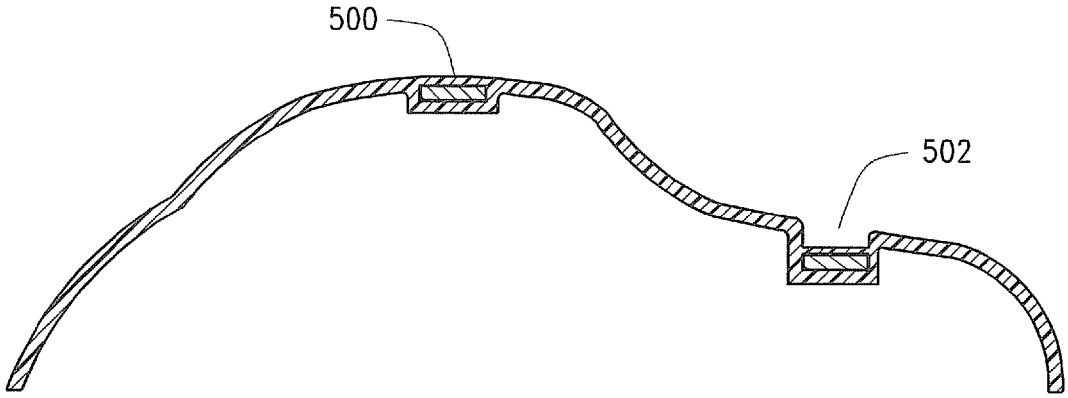
FIG. 6 is a sectional view of the magnetic body mounts.

Referring to FIG. 5, a perspective view showing the location of the magnetic body mounts is shown. There can be magnetic body mounts located at various positions on the body. For example, a roof magnet mount 500 is shown along with a hood magnet mount 502 and a similarly designed rear magnet mount (not shown). The accessory to be attached in these areas can have a magnet of a particular polarity imbedded therein before attaching the accessory having opposite polarity to the respective locations. FIG. 6 reveals a sectional view of the magnetic body mounts indicating that the magnets can be located just beneath the surface of the body such that accessories can be readily attached. The magnets beneath the surface can have sufficient strength to attached the magnet having opposite polarity that is within the given accessory. The magnets for the body mount and for the magnetic accessory can be embedded within the structure of the respective items beneath the outer surface or just simply placed on an opposing interior side surface. Various accessories can be attached such as for example hood scoops, emergency lighting or other ornamental accessories. The magnetic mounts provide an alternative universal mount that can be utilized for mounting various types of accessories to different portions of the chassis body. The locations indicated in the view shown in FIG. 6 and FIG. 5 are not the only locations where magnetic mounts can be placed. Magnetic mounts can be imbedded in the chassis body in other areas including the doors and corner panels.

The various examples shown above illustrate a novel method and apparatus for providing a universal docketing mechanism for accessories of toy vehicles. A user of the present invention may choose any of the above accessory system embodiments, or an equivalent thereof, depending upon the desired application. In this regard, it is recognized that various forms of the subject toy vehicle accessory mounts could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained study of the drawings, the disclosure and the appended claims.

What is claimed is:

1. A toy vehicle accessory mounting system comprising:

a toy vehicle body mounted on a toy vehicle chassis where said body substantially covers a top portion, left and right side portions, and front and rear end portions of said chassis;

a first stirrup-like pliable u-shaped loop protruding vertically downward from an underside surface of said chassis having a first opening and adjacent one of said left side, right side, front end or rear end portions of said chassis for receiving tabs of accessories in said first opening; and a second stirrup-like pliable u-shaped loop protruding vertically downward from the underside surface of said chassis having a second opening and disposed adjacent a same side as said first stirrup-like pliable u-shaped loop and aft of said first stirrup-like pliable u-shaped loop a predetermined distance along the same side for receiving tabs of accessories in said second opening.

2. The mounting system as recited in claim 1, further comprising:

an electrical chassis connector aligned between said first stirrup-like pliable u-shaped loop and said second stirrup-like pliable u-shaped loop and having an interface oriented and adapted for laterally receiving a mating electrical accessory connector.

3. The mounting system as recited in claim 2, further comprising:

an accessory having first and second tabs inserted and mounted in said first and second openings respectively of said first and second stirrup-like pliable u-shaped loops.

4. The mounting system as recited in claim 3, where said accessory has said mating electrical accessory connector electrically connected to said electrical chassis connector.

5. The mounting system as recited in claim 1, where said first stirrup-like pliable u-shaped loop is adjacent one of said front end or rear end and where said second stirrup-like pliable u-shaped loop protruding vertically downward from the underside surface of said chassis having a second opening and disposed adjacent a same end as said first stirrup-like pliable u-shaped loop and laterally space apart from said first stirrup-like pliable u-shaped loop a predetermined distance along the same end for receiving tabs of accessories in said second opening.

6. The mounting system as recited in claim 5, further comprising:

an accessory having first and second tabs inserted and mounted in said first and second openings respectively of said first and second stirrup-like pliable u-shaped loops.

7. The mounting system as recited in claim 6, where said accessory has said mating electrical accessory connector electrically connected to said electrical chassis connector.

8. The mounting system as recited in claim 7, where said chassis has a power source electrically connected to said electrical chassis connector for providing power to an accessory.

9. The mounting system as recited in claim 8, where said accessory has a light adapted to be powered through said electrical accessory connector by said power source.

10. A toy vehicle accessory mounting system comprising:

a toy vehicle body mounted on a toy vehicle chassis where said body substantially covers a top portion, left and right side portions, and front and rear end portions of said chassis;

a first stirrup-like pliable u-shaped loop protruding vertically downward from an underside surface of said chassis having a first opening and adjacent one of said left side, right side, front end or rear end portions of said chassis for receiving tabs of accessories in said first opening;

a second stirrup-like pliable u-shaped loop protruding vertically downward from the underside surface of said chassis having a second opening and disposed adjacent a same end as said first stirrup-like pliable u-shaped loop and laterally space apart from said first stirrup-like pliable u-shaped loop a predetermined distance along the same end for receiving tabs of accessories in said second opening; and a first magnet mount having a magnet with a first polarity beneath a body surface area of said body for attracting a magnetic accessory having a second magnet embedded beneath an accessory surface area of said accessory.

11. The mounting system as recited in claim 10, where the first magnet mount is a hood magnet mount and the body surface area of said body is the hood surface area.

12. The mounting system as recited in claim 10, where the first magnet mount is a roof magnet mount and the body surface area of said body is the roof surface area.

13. The mounting system as recited in claim 10, where the first magnet mount is a rear magnet mount and the body surface area of said body is the rear surface area.

14. A method for mounting accessories to a toy vehicle comprising the steps of:

providing a toy vehicle body mounted on a toy vehicle chassis where said body substantially covers a top portion, left and right side portions, and front and rear end portions of said chassis;

providing a first stirrup-like pliable u-shaped loop protruding from an underside surface of said chassis having a first opening and adjacent one of said left side, right side, front end or rear end portions of said chassis for receiving tabs of accessories in said first opening;

providing a second stirrup-like pliable u-shaped loop protruding vertically downward from the underside surface of said chassis having a second opening and disposed adjacent a same end as said first stirrup-like pliable u-shaped loop and laterally space apart from said first stirrup-like pliable u-shaped loop a predetermined distance along the same end for receiving tabs of accessories in said second opening; and placing a first magnet mount having a magnet with a first polarity beneath a body surface area of said body for attracting a magnetic accessory having a second magnet embedded beneath an accessory surface area of said accessory.

15. A method for mounting accessories to a toy vehicle comprising the steps of:

providing a toy vehicle body mounted on a toy vehicle chassis where said body substantially covers a top portion, left and right side portions, and front and rear end portions of said chassis;

providing a first stirrup-like pliable u-shaped loop protruding vertically downward from an underside surface of said chassis having a first closed loop opening defined by vertically opposing side loop portions side to side, a bottom loop portion horizontally below and said side loop portions attached to the underside surface above and adjacent one of said left side, right side, front end or rear end portions of said chassis for receiving tabs of accessories in said first opening.

* * * * *

UNITED STATES PATENT AND TRADEMARK OFFICE

CERTIFICATE OF CORRECTION

PATENT NO. : 7,717,767 B2
APPLICATION NO. : 11/735995
DATED : May 18, 2010
INVENTOR(S) : Donald W. Amadio It is certified that error appears in the above-identified patent and that said Letters Patent is hereby corrected as shown below:

In Col. 4, line 41, delete "constricted" and replace with -- constructed --

In Col. 5, line 49, after the word *obtained,* insert -- from a --

In Claim 14, Col. 7, line 17, after the word *protruding*, insert -- vertically downward --

Signed and Sealed this

Seventeenth Day of August, 2010

David J. Kappos

David J. Kappos
*Director of the United States Patent and Trademark Office*